US008888665B2

(12) United States Patent
Pfitzer

(10) Patent No.: US 8,888,665 B2
(45) Date of Patent: Nov. 18, 2014

(54) EXERCISE DEVICE

(71) Applicant: Daniel Lee Pfitzer, Toledo, OH (US)

(72) Inventor: Daniel Lee Pfitzer, Toledo, OH (US)

(73) Assignee: Fitness Stability Dynamics, LLC, Toledo, OH (US)

( * ) Notice: Subject to any disclaimer, the term of this patent is extended or adjusted under 35 U.S.C. 154(b) by 0 days.

(21) Appl. No.: 13/802,925

(22) Filed: Mar. 14, 2013

(65) Prior Publication Data

US 2013/0196830 A1 Aug. 1, 2013

Related U.S. Application Data

(63) Continuation-in-part of application No. 13/079,832, filed on Apr. 5, 2011.

(60) Provisional application No. 61/321,535, filed on Apr. 7, 2010.

(51) Int. Cl.

| | |
|---|---|
| ***A63B 21/00*** | (2006.01) |
| ***A63B 21/06*** | (2006.01) |
| ***A63B 21/075*** | (2006.01) |
| ***A63B 23/035*** | (2006.01) |
| ***A63B 21/072*** | (2006.01) |
| *A63B 71/06* | (2006.01) |

(52) U.S. Cl.

CPC ..... *A63B 21/0618* (2013.01); *A63B 21/075* (2013.01); *A63B 23/03575* (2013.01); *A63B 21/0724* (2013.01); *A63B 21/0603* (2013.01); *A63B 21/0608* (2013.01); *A63B 21/0728* (2013.01); *A63B 2071/0655* (2013.01); *A63B 21/0602* (2013.01); *A63B 2071/0652* (2013.01)

USPC ..... 482/104; 482/110; 482/109; 482/106

(58) Field of Classification Search

USPC ..... 482/104, 105, 106, 107, 11, 91, 101, 482/110, 108

See application file for complete search history.

(56) References Cited

U.S. PATENT DOCUMENTS

| | | | | |
|---|---|---|---|---|
| 4,480,828 | A * | 11/1984 | Kifferstein | 482/74 |
| 4,567,668 | A | 2/1986 | King et al. | |
| 5,178,597 | A | 1/1993 | Jones | |
| 5,212,314 | A * | 5/1993 | Jones et al. | 546/256 |
| 5,244,445 | A * | 9/1993 | Amesquita | 482/110 |
| 5,364,325 | A * | 11/1994 | Matthews | 482/111 |
| 5,393,285 | A | 2/1995 | Fischer, Sr. et al. | |
| 5,445,587 | A | 8/1995 | Brown | |
| 5,509,877 | A | 4/1996 | Adams | |

(Continued)

FOREIGN PATENT DOCUMENTS

| | | | |
|---|---|---|---|
| CN | 201519423 | U | 7/2010 |
| DE | 29800445 | U1 | 3/1998 |

(Continued)

*Primary Examiner* — Jerome w Donnelly

(74) *Attorney, Agent, or Firm* — Brenda J. Kruse; Ferguson, Wacha & Kruse, LLC

(57) ABSTRACT

An exercise device is disclosed having a main body including a chamber formed therein and a pair of spaced apart outer hubs disposed thereon. The main body is configured to be grasped by a user. The exercise device may also include at least one containment article having a chamber formed therein and extending between the outer hubs. A displaceable component may be disposed in the chamber of at least one of the main body and the at least one containment article to provide a selected total weight to the exercise device.

19 Claims, 9 Drawing Sheets

(56) References Cited

U.S. PATENT DOCUMENTS

| | | | |
|---|---|---|---|
| 5,509,880 | A | 4/1996 | Becker et al. |
| 5,653,664 | A | 8/1997 | Jennings |
| 5,857,946 | A | 1/1999 | Brown |
| 5,876,312 | A | 3/1999 | McClendon |
| D449,863 | S | 10/2001 | Kinde |
| 6,379,286 | B1 | 4/2002 | Scopino et al. |
| 6,599,222 | B2 | 7/2003 | Wince |
| 6,758,795 | B2 | 7/2004 | Barber |
| 6,981,933 | B2 | 1/2006 | Scafidel |
| 7,090,625 | B2 | 8/2006 | Chermack |
| D544,554 | S | 6/2007 | Brun |
| 7,364,536 | B2 | 4/2008 | Cappellini et al. |
| 7,455,621 | B1 | 11/2008 | Anthony |
| 7,563,216 | B1 | 7/2009 | Kest |
| 7,749,145 | B2 | 7/2010 | Allen et al. |
| 7,798,944 | B2 | 9/2010 | Suber, III et al. |
| D633,155 | S | 2/2011 | Brun |
| 8,038,585 | B1 * | 10/2011 | Brown, Jr. ..... 482/110 |
| 8,162,808 | B2 | 4/2012 | Cook |
| 8,262,546 | B1 | 9/2012 | Lashinske et al. |
| 2004/0063554 | A1 | 4/2004 | Wince |
| 2007/0287600 | A1 | 12/2007 | Prenatt |
| 2008/0312053 | A1 | 12/2008 | Kay |
| 2009/0298606 | A1 | 12/2009 | Kim |
| 2012/0129653 | A1 | 5/2012 | Shalev et al. |
| 2012/0302409 | A1 | 11/2012 | Mikulski |

FOREIGN PATENT DOCUMENTS

| | | | |
|---|---|---|---|
| DE | 202009017604 | U1 | 5/2010 |
| JP | 239763 | U | 3/1990 |
| JP | 2001145706 | A | 5/2001 |
| JP | 2002191717 | A | 7/2002 |
| WO | 02051505 | A2 | 7/2002 |

* cited by examiner

EXERCISE DEVICE

CROSS REFERENCE TO RELATED APPLICATIONS

This application is a continuation-in-part of U.S. utility patent application Ser. No. 13/079,832 filed Apr. 5, 2011 and claims the benefit of U.S. provisional patent application Ser. No. 61/321,535 filed Apr. 7, 2010 and, the entire disclosures of which are incorporated herein by reference.

FIELD OF THE INVENTION

The invention relates to an exercise device and more particularly to an exercise device having a chamber formed therein for containing at least one displaceable component.

BACKGROUND OF THE INVENTION

Exercise devices can be an important aid to individuals seeking to maintain and improve a level of physical fitness. One type of exercise device is often called a slosh pipe or a slosh tube. The slosh pipe includes a chamber formed therein. A flowable material such as water or sand, for example, is disposed within the chamber.

In use, a person uses legs or arms, for example, to raise and lower the slosh pipe while trying to maintain the slosh pipe in a level position to militate against a flow of the flowable material within the chamber. In the event the flowable material flows toward one of the ends of the slosh pipe while being raised or lowered, the person senses a change in the distribution of the flowable material through a change in the balance of the weight of the slosh pipe. The person must adjust movement in an attempt to return the exercise devise to a level position and restore the uniform distribution of the flowable material therein.

The slosh pipe may be employed to promote muscle coordination and overall balance of a user. Additionally, fine muscle control often needed to maintain the slosh pipe in a level position may provide targeted exercise of certain muscle groups that are not exercised or difficult to exercise employing traditional exercise devices such as free weights, dumbbells, and the like, for example.

Despite the potential benefits that exercise with the slosh pipe can provide, some individuals may forego the use of the slosh pipe due to a perceived or actual difficulty of using the slosh pipe. Further, the slosh pipe typically only provides tactile feedback to a user. Providing feedback to the user through other senses such as the sense of sight, for example, may provide additional fitness benefits and minimize the perceived or actual difficulty of exercising with the slosh pipe.

It would be desirable to produce an exercise device including at least one displaceable component disposed therein, wherein tactile and visual feedback are provided to a user in respect of maintaining an even distribution of the at least one displaceable component while using the exercise device.

SUMMARY OF THE INVENTION

In concordance and agreement with the present invention, an exercise device including at least one displaceable component disposed therein, wherein tactile and visual feedback are provided to a user in respect of maintaining an even distribution of the at least one displaceable component while using the exercise device, has surprisingly been discovered.

In one embodiment, an exercise device comprises: a main body including at least one chamber formed therein, at least a portion of the main body configured to be grasped by a user; and a first displaceable component disposed within the at least one chamber, wherein the first displaceable component is at least one rolling component.

In another embodiment, an exercise device comprises: a main body including a plurality of hubs disposed thereon and at least one chamber formed therein, at least a portion of the main body configured to be grasped by a user; and at least one containment article extending between the hubs of the main body, the at least one containment article including at least one chamber formed therein, wherein at least one displaceable component is disposed within at least one of the at least one chamber of the main body and the at least one chamber of the at least one containment article.

In yet another embodiment, an exercise device comprises: a main body including a plurality of hubs disposed thereon and at least one chamber formed therein, at least a portion of the main body configured to be grasped by a user; a first displaceable component disposed within the at least one chamber of the main body, wherein the first displaceable component is at least one of a flowable component, a slidable component, and a rolling component; and at least one containment article extending between the hubs of the main body.

The present invention is advantageous over prior art exercise devices by providing the benefit of functional training. Functional training enables a body of a user to react quickly, as well as enhances the ability of the body to perform designated tasks. Further, functional training provides a neurological adaptation component to a workout which is lacking in traditional machine or dumbbell training. For example, the nervous system is required to adapt to new stimuli when the body adjusts quickly or reacts to an unpredictable outside influence such as the movement of the displaceable component inside the exercise device of the present invention. Accordingly, the present invention trains the user to be multifunctional, preparing the user for activities of daily life.

BRIEF DESCRIPTION OF THE DRAWINGS

The above advantages of the invention will become readily apparent to those skilled in the art from reading the following detailed description of an embodiment of the invention in the light of the accompanying drawings, in which.

DETAILED DESCRIPTION OF THE PREFERRED EMBODIMENT OF THE INVENTION

The following detailed description and appended drawings describe and illustrate various exemplary embodiments of the invention. The description and drawings serve to enable one skilled in the art to make and use the invention, and are not intended to limit the scope of the invention in any manner.

Figure 1:
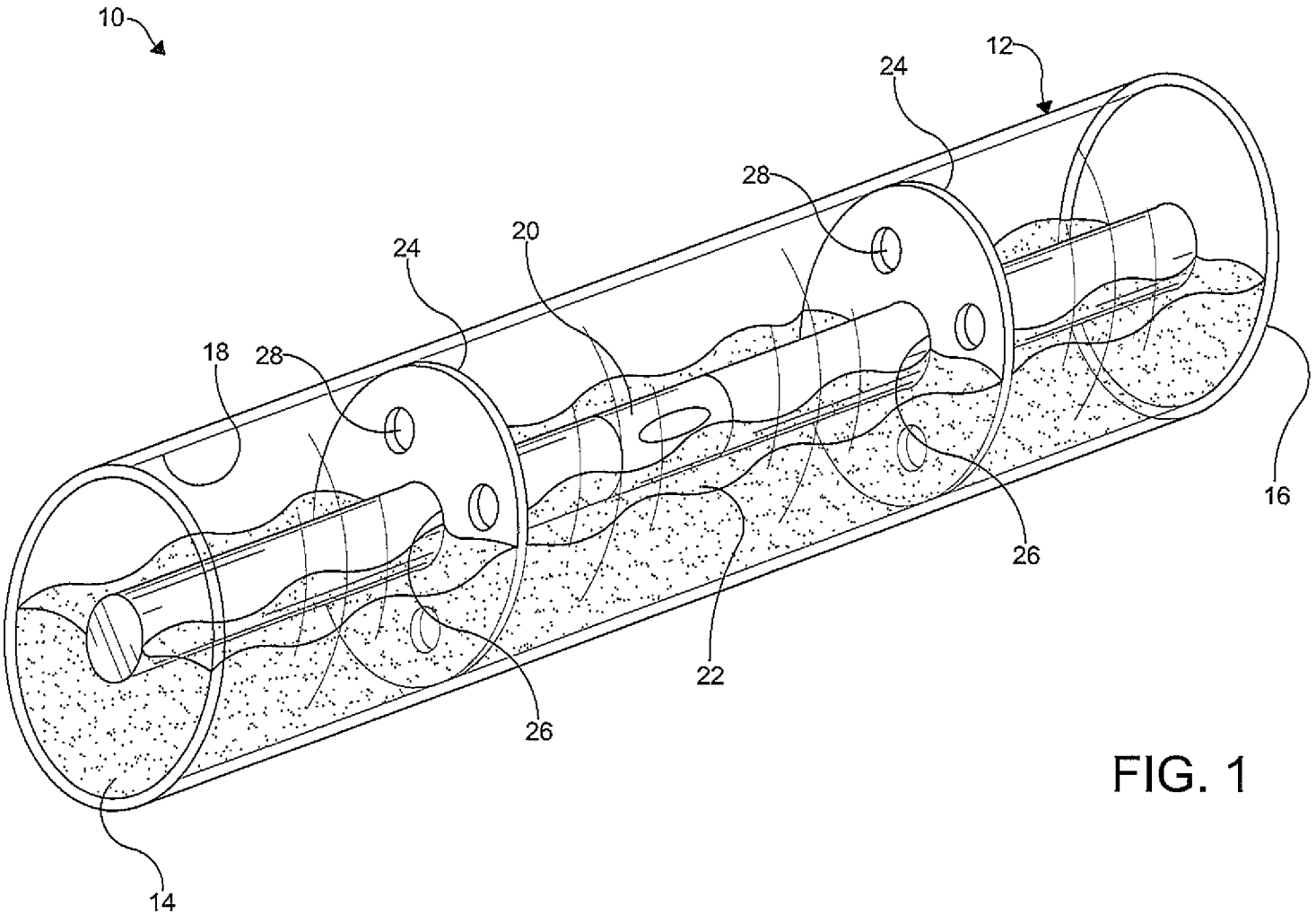
FIG. 1 is a perspective view of an exercise device according to an embodiment of the invention.

Referring now to FIG. 1, there is shown an exercise device 10 according to an embodiment of the invention. The exercise device 10 includes an elongate hollow main body 12 having end caps 14, 16 disposed on opposing ends thereof. In the illustrated embodiment the main body 12 is formed from a substantially transparent material. It should be understood that the main body 12 may be formed from translucent materials and opaque materials. The main body 12 and end caps 14, 16 form a substantially media tight chamber 18 within the main body 12. It should be understood that the end caps 14, 16 can include a sealing member such as an O-ring, a flat gasket, and the like, for example. In the embodiment shown, at least one of the end caps 14, 16 is removably disposed on the main body 12 to provide an opening into the hollow interior of the main body 12. It should be understood that the main body 12 can be adapted to receive weight plates and the like thereon.

A level indicator 20 is disposed within the chamber 18. In the illustrated embodiment, the level indicator 20 is an elongate spirit level, often referred to as a bubble level. Ends of the level indicator 20 are coupled to the respective end caps 14, 16 to position the level indicator 20 substantially co-axially with the main body 12. The level indicator 20 is visible through the substantially transparent main body 12. It should be understood that the level indicator 20 can be formed from an elongate support member having a level indicator such as a spirit level attached thereto. It should also be understood that the level indicator 20 can be coupled to the main body 12 on an inner surface or an outer surface thereof.

At least one displaceable component 22 such as a flowable component (e.g. at least one fluid or granular material), a slidable component (e.g. at least one linear slide), a rolling component (e.g. at least one generally spherical body), or any combination thereof, for example, is disposed within the chamber 18. One or more displaceable components 22 fill at least a portion of the chamber 18, wherein the displaceable component 22 can move between the inner surface of the main body 12 and an outer surface of the level indicator 20 and the ends of the main body 12. It should be understood that a selected number or amount of the displaceable component 22 can be disposed within the chamber 18 to provide a selected total weight to the exercise device 10. It is also contemplated that at least a portion of the main body 12 and/or the end caps 14, 16 may include at least one dampening member (not shown) disposed thereon or formed therein such as a rubber mount, for example, to attenuate a noise and vibration produced when the displaceable component 22 contacts the main body 12 and/or the end caps 14, 16 during operation.

One or more baffles 24 may be disposed within the chamber 18 to restrict a movement of the displaceable component 22 within the chamber 18 or dampen the movement thereof. In the illustrated embodiment, the baffles 24 are disk shaped members having a central opening 26, wherein the central opening of the disk receives the level indicator 20 to position the disk between the level indicator 20 and the inner surface of the chamber 18 to reduce an area of movement therebetween. The baffle 24 may include a plurality of openings 28 formed therein to allow the displaceable component 22 to move through the baffle 24. It should be understood that other baffles 24 can be used such as a fibrous material, for example. It should also be understood that the baffles 24 can be removed from or inserted into the chamber 18 as desired to provide a desired level of resistance of the displaceable component 22.

In use, one of the end caps 14, 16 is removed from the end of the main body 12 to provide access to the chamber 18 formed therein. The selected number or amount of the displaceable component 22 is disposed within the chamber 18. Typically, the chamber 18 is partially filled with the displaceable component 22 to allow the displaceable component 22 to freely move within the chamber 18. One or more of the baffles 24 may be disposed within the chamber 18 to restrict the movement of the displaceable component 22. The one of the end caps 14, 16 is attached to the main body 12 to retain the displaceable component 22 within the chamber 18 and facilitate securing the level indicator 20 to the main body 12. It should be understood that weight plates can be attached to the main body 12 to cooperate with the displaceable component 22 to provide a desired total weight for the exercise device 10.

A user grasps the main body 12 of the exercise device 10 with one or two hands and performs a selected exercise movement that causes a movement of the exercise device 10. The user attempts to maintain the exercise device 10 substantially level throughout the exercise movement to minimize a movement of the displaceable component 22 within the chamber 18. In the event the level position is not maintained, the displaceable component 22 will move toward one of the ends of the chamber 18 creating an uneven distribution of the displaceable component 22 along a length of the exercise device 10. Tactile feedback is provided to the user as the uneven distribution of the displaceable component 22 will be felt as an imbalance of the exercise device 10. Further, the exercise device 10 is positioned by the user so that the level indicator 20 can be viewed by the user while performing the exercise movement. The level indicator 20 provides a visual input to the user as to the level position of the exercise device 10. The user employs the tactile input provided by the movement of the displaceable component 22 and the visual input provided by the level indicator 20 to coordinate body movement to maintain the exercise device 10 in a level position throughout the exercise movement. It should be understood that the baffles 24 may be employed by users that are not experienced performing exercise movements with the exercise device 10 to minimize the tactile feedback resulting from not maintaining the exercise device 10 in the level position. As a user improves an ability to maintain the level position of the exercise device 10, fewer or no baffles 24 may be employed to maximize the tactile feedback.

Figure 2:
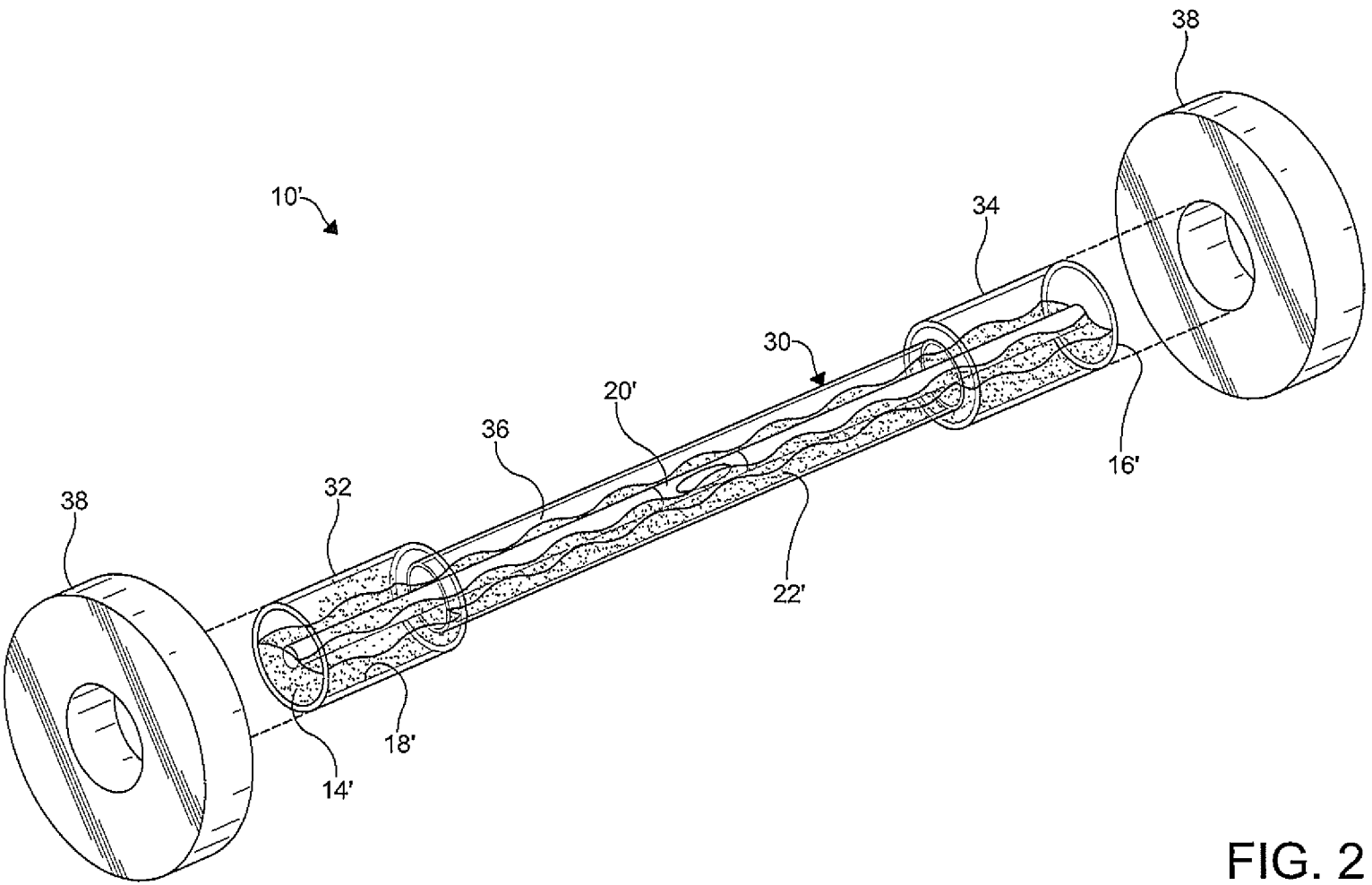
FIG. 2 is an exploded perspective view of an exercise device according to another embodiment of the invention.

FIG. 2 shows an alternate embodiment of the exercise device 10 shown in FIG. 1. Structure similar to that illustrated in FIG. 1 includes the same reference numeral and a prime (') symbol for clarity. In FIG. 2, an exercise device 10' is shown having an elongate hollow main body 30 including opposing ends 32, 34 and a central portion 36 between the ends 32, 34. End caps 14', 16' are disposed on the respective ends 32, 34 of the main body 30. The main body 30 and the end caps 14', 16' form a substantially media tight chamber 18' within the main body 30. A diameter of the central portion 36 of the main body 30 is smaller than a diameter of the ends 32, 34 to facilitate a user grasping the central portion 36 of the main body 30. The ends 32, 34 can be adapted to receive weight plates 38 and the like thereon. It should be understood that the weight plates 38 can be substantially secured to the ends 32, 34 employing an interference fit or a retaining collar, as is commonly known in the art. Further, a thread can be formed in each of the ends 32, 34 to facilitate receiving the weight plates 38 or the retaining collar. One or more baffles (not shown) can be disposed within the chamber 18'. The remaining structure and use of the exercise device 10' is substantially the same as the structure and use of the exercise device 10 shown in FIG. 1 and described herein above.

Figure 3:
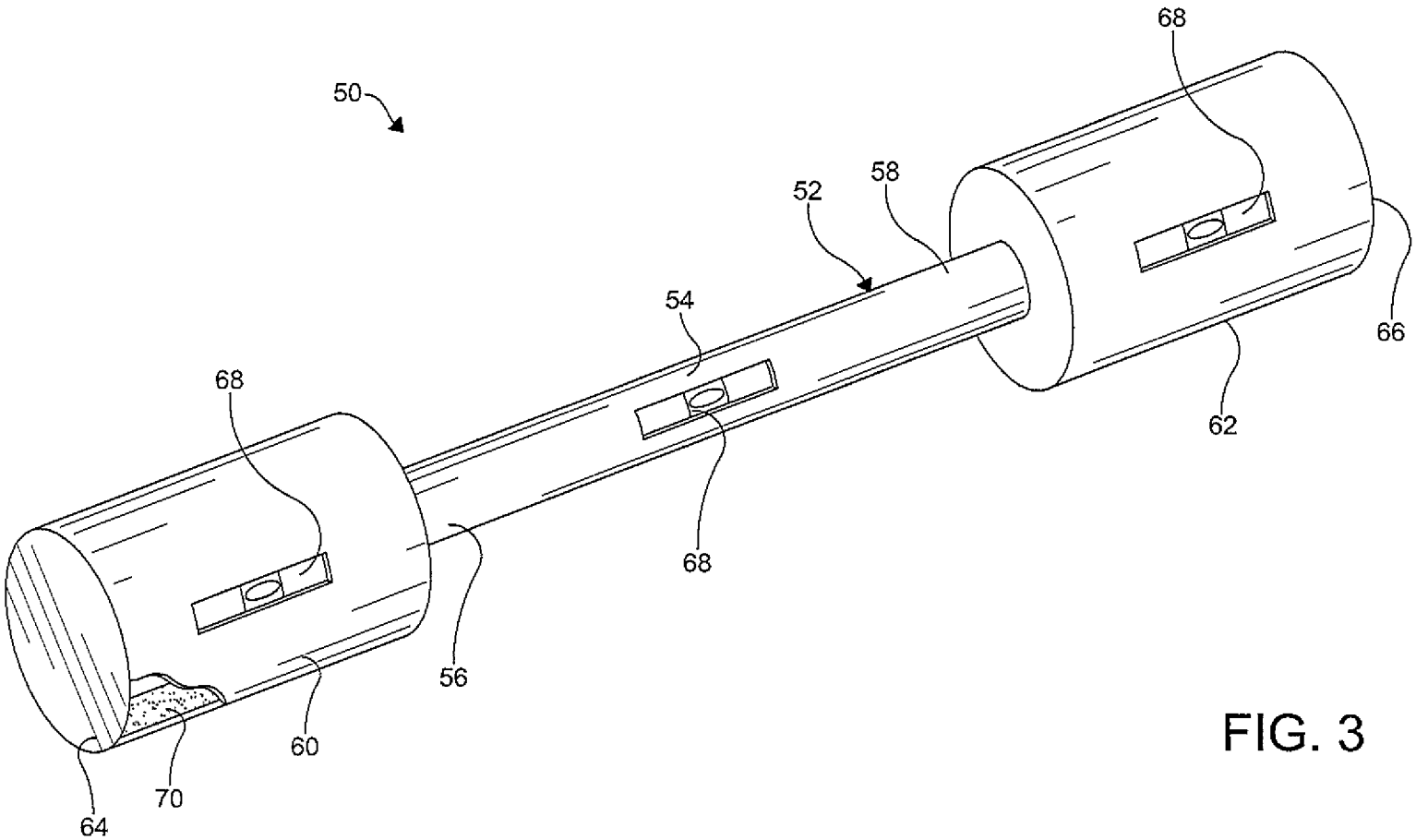
FIG. 3 is a perspective view of an exercise device according to another embodiment of the invention, having a portion thereof cutaway.

In FIG. 3, an exercise device 50 is illustrated showing another embodiment of the invention. The exercise device 50 includes a main body 52 including a bar 54 having opposing ends 56, 58. A pair of hollow substantially media tight chambers 60, 62 is disposed on the ends 56, 58, respectively, of the bar 54. In the illustrated embodiment, the bar 54 is substantially linear. It should be understood that the bar 54 can include bends and curved portions such as an exercise bar commonly known as an E-Z curl bar, for example. It should also be understood that the chambers 60, 62 may be removably disposed on the ends 56, 58 to allow for the use of different sized and shaped chambers 60, 62. Further, the chambers 60, 62 can be adapted to receive weight plates and the like thereon. The chambers 60, 62 include end caps 64, 66, respectively, disposed on an end thereof. The end caps 64, 66 are removably disposed on the chambers 60, 62 to provide an opening into the hollow interior thereof. The end caps 64, 66 facilitate forming a substantially media tight seal between the chambers 60, 62 and the end caps 64, 66. It should be understood that the end caps 64, 66 can include a sealing member such as an O-ring, a flat gasket, and the like, for example.

Level indicators 68 are provided on an exterior surface of the bar 54 and an exterior surface of the chambers 60, 62. It should be understood that a single level indicator 68 can be used and attached to one of the bar 54 and the chambers 60, 62. Further, the level indicators 68 can be disposed in the bar 54 and the chambers 60, 62 such as within a countersink and a cavity formed therein, for example.

At least one displaceable component 70 such as a flowable component (e.g. at least one fluid or a granular material), a slidable component (e.g. at least one linear slide), a rolling component (e.g. at least one generally spherical body), or any combination thereof, for example, is disposed within the chambers 60, 62. One or more displaceable components 70 fill at least a portion of the chambers 60, 62, wherein the displaceable component 70 can move therein. It should be understood that a selected number or amount of the displaceable component 70 can be disposed within the chambers 60, 62 to provide a selected total weight to the exercise device 50. One or more baffles (not shown) can be disposed within the chamber 60, 62 to restrict the movement of the displaceable component 70 therein.

The remaining structure and use of the exercise device 50 is substantially the same as the structure and use of the exercise device 10 shown in FIG. 1 and described hereinabove.

Figure 4:
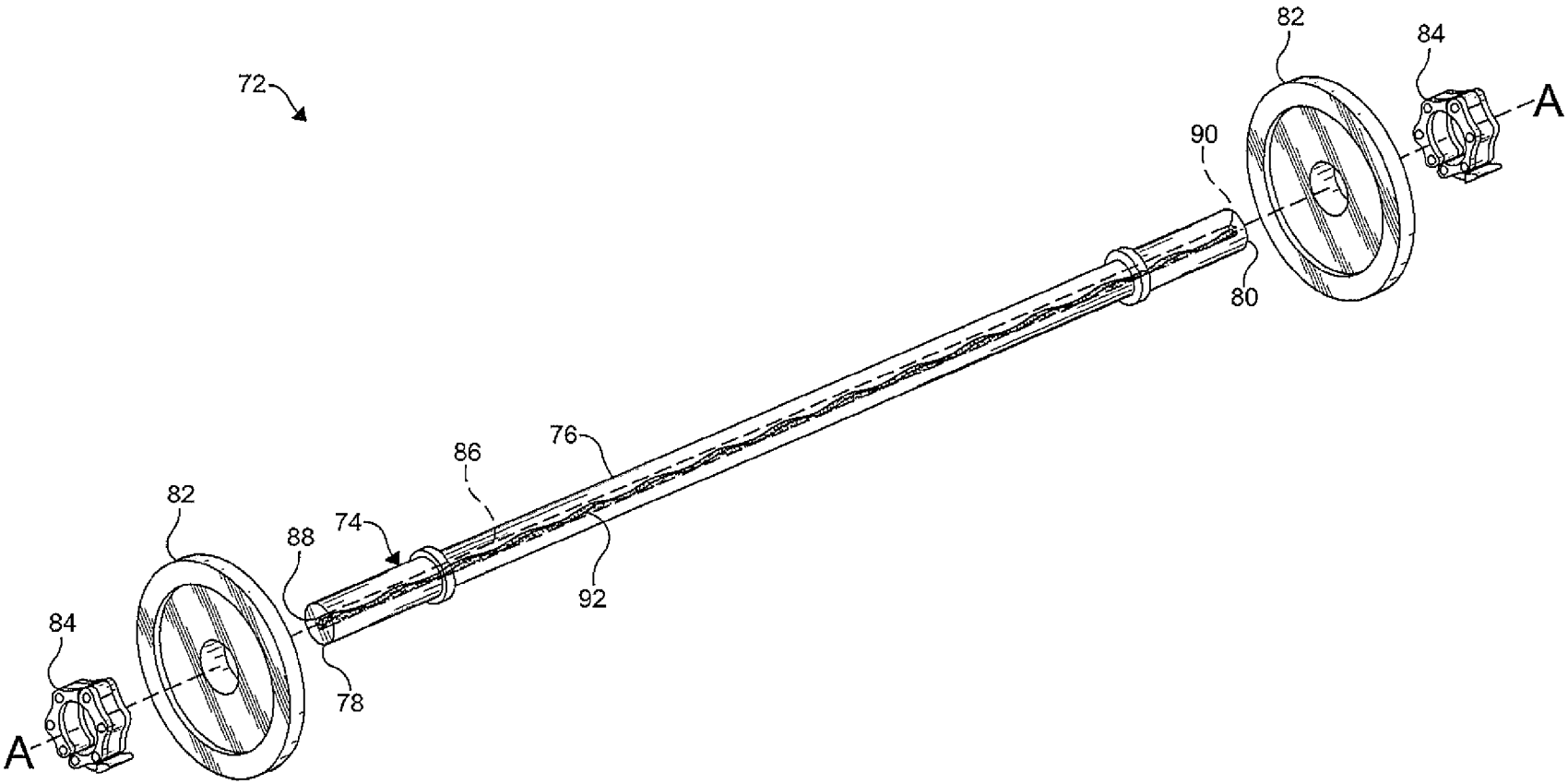
FIG. 4 is an exploded perspective view of an exercise device according to another embodiment of the invention.

In FIG. 4, an exercise device 72 is illustrated showing another embodiment of the invention. The exercise device 72 includes a main body 74 including a bar 76 having opposing ends 78, 80. As a non-limiting example, the bar 76 is similar in size and shape to a conventional Olympic barbell. However, it is understood that the bar 76 can have any shape and size. Further, the bar 76 can be adapted to receive a plurality of weight plates 82 and locking collars 84 as appreciated by one skilled in the art.

A substantially media tight chamber 86 is substantially centrally formed along a longitudinal axis A-A of the bar 76. In the illustrated embodiment, the bar 76 and the chamber 86 are substantially linear. It should be understood that the bar can include bends and curved portions such as an exercise bar commonly known as an E-Z curl bar, for example. The bar 76 typically includes end caps 88, 90, respectively disposed on the opposing ends 78, 80. The end caps 88, 90 are removably disposed on the bar 76 to provide an opening into the chamber 86. The end caps 88, 90 facilitate forming a substantially media tight seal between the bar 76 and the end caps 88, 90. It should be understood that the end caps 88, 90 can include a sealing member such as an O-ring, a flat gasket, and the like, for example. It is further understood that the chamber 86 can be sealed using other means. In certain embodiments, a level indicator (not shown) is coupled to an exterior surface of the bar 76.

At least one displaceable component 92 such as a flowable component (e.g. at least one fluid or granular material), a slidable component (e.g. at least one linear slide), a rolling component (e.g. at least one generally spherical body), or any combination thereof, for example, is disposed within the chamber 86. One or more displaceable components 92 fill at least a portion of the chamber 86, wherein the displaceable component 92 can move therein. It should be understood that a selected number or amount of the displaceable component 92 can be disposed within the chamber 86 to provide a selected total weight to the exercise device 72. One or more baffles (not shown) can be disposed within the chamber 86 to restrict the movement of the displaceable component 92 therein. It is also contemplated that at least a portion of the bar 76 and/or the end caps 88, 90 may include at least one dampening member (not shown) disposed thereon or formed therein such as a rubber mount, for example, to attenuate a noise and vibration produced when the displaceable component 92 contacts the bar 76 and/or the end caps 88, 90 during operation.

The remaining structure and use of the exercise device 72 is substantially the same as the structure and use of the exercise device 10 shown in FIG. 1 and described herein above.

Figure 5:
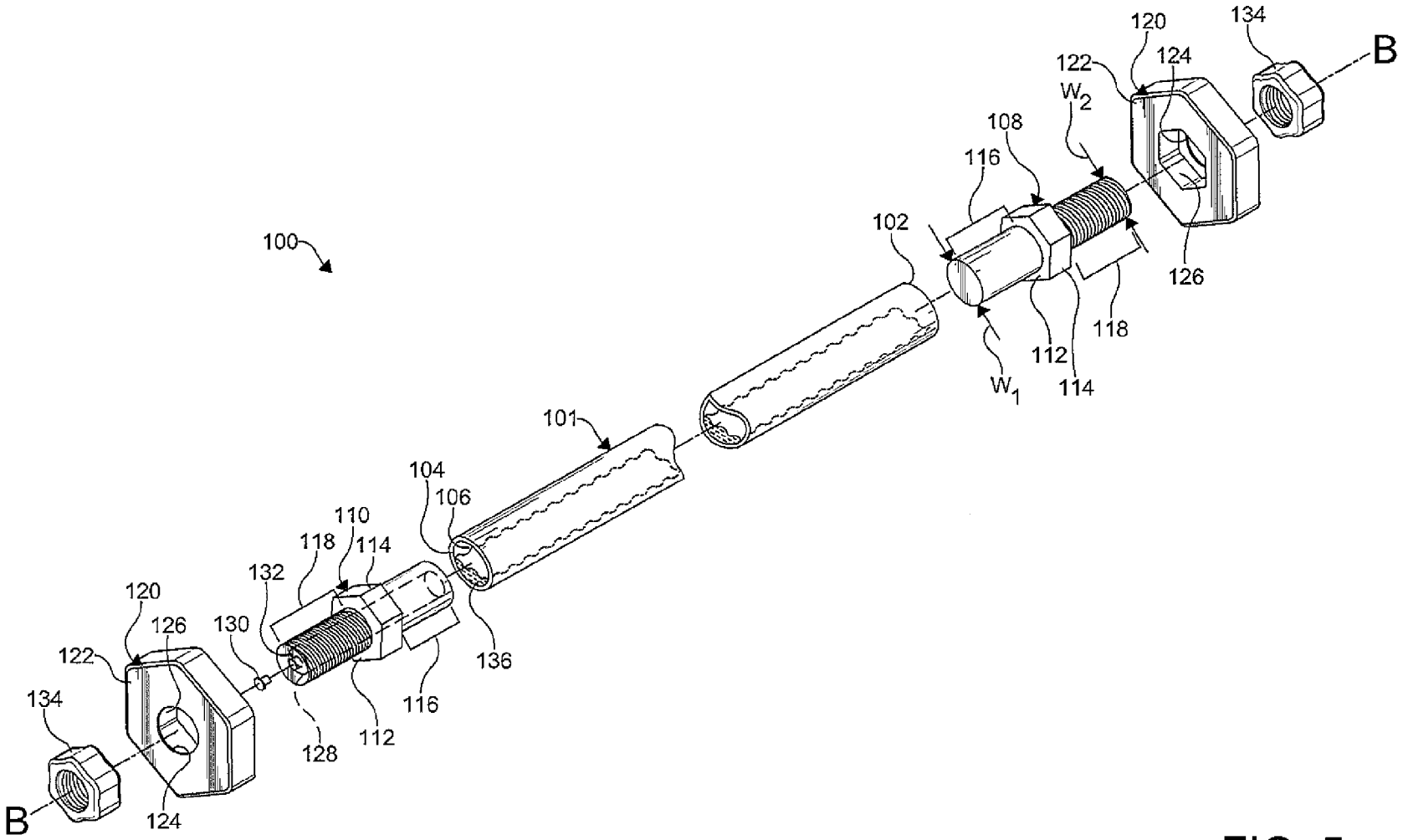
FIG. 5 is an exploded perspective view of an exercise device according to another embodiment of the invention.

In FIG. 5, an exercise device 100 is illustrated showing another embodiment of the invention. The exercise device 100 includes a main body 101 having opposing ends 102, 104. As a non-limiting example, the main body 101 is a hollow tube. However, it is understood that the main body 101 can have any shape and size. Further, the main body 101 can be adapted to receive a plurality of weight plates (not shown) as appreciated by one skilled in the art.

A substantially media tight chamber 106 is substantially centrally formed along a longitudinal axis B-B of the main body 101. In the illustrated embodiment, the main body 101 and the chamber 106 are substantially linear. It should be understood that the main body 101 can include bends and curved portions, for example. The main body 101 typically includes end caps 108, 110 or inserts disposed in/on the opposing ends 102, 104 thereof. At least one of the end caps 108, 110 is removably disposed in the main body 101 to facilitate forming a substantially media tight seal between the main body 101 and the at least one of the end caps 108, 110. It should be understood that the end caps 108, 110 can include a sealing member such as an O-ring, a flat gasket, and the like, for example.

In the embodiment shown, each of the end caps 108, 110 includes a main body 112 having an integral hub 114 circumferentially disposed around the main body 112 and extending radially outwardly therefrom. As a non-limiting example, the integral hub 114 is disposed intermediate opposing ends of the respective main body 112 of each of the end caps 108, 110. As a further non-limiting example, the integral hubs 114 have a generally hexagonal shape. However, the integral hubs 114 can have any size and shape, as desired.

In certain embodiments, the main body 112 (e.g. formed polyvinyl chloride) of each of the end caps 108, 110 includes an interior portion 116 and an exterior portion 118 extending axially outwardly in generally opposing directions from the integral hub 114. As a non-limiting example, each of the interior portion 116 and the exterior portion 118 has a substantially cylindrical shape. As a further non-limiting example, the interior portion 116 has a diameter W1 that is greater than a diameter W2 of the exterior portion 118. However, the interior portion 116 and the exterior portion 118 can have any size and shape relative to each other.

In certain embodiments, an outer hub 120 is disposed adjacent the integral hub 114 of the main body 112 of each of the end caps 108, 110. Specifically, the outer hubs 120 each include a main body 122 having an aperture 124 formed therein and a recessed portion 126 circumferentially formed adjacent the aperture 124. As a non-limiting example, the aperture 124 is generally circular to receive the exterior portion 118 of an associated one of the end caps 108, 110. As a further non-limiting example, the recessed portion 126 has a shape (e.g. generally hexagonal) to receive the integral hub 114 of one of the end caps 108, 110 and thereby secure the outer hub 120 to the integral 114. It is understood that the outer hubs 120 can be bonded to the integral hubs 114. It is further understood that the outer hubs 120 can be formed from polyurethane to optimize a bonding with the integral hubs 114. However, other materials can be used.

In the embodiment shown, at least one of the end caps 108, 110 includes a channel 128 formed therethrough to allow a displaceable component to pass therethrough. As a non-limiting example, a plug 130 is removeably received in an end of the channel 128 to provide a fluid tight seal and to militate against a fluid passing through the channel 128. As a further non-limiting example, a port 132 or purge hole is in fluid communication with the channel 128 to allow air from the chamber 106 to pass therethrough, as understood in the art.

In certain embodiments, the exterior portions 118 of each of the end caps 108, 110 are adapted to receive a retaining element 134 or collar. As a non-limiting example, the exterior portions 118 are threaded to threadably engage the retaining element 134 to militate against undesired movement of the retaining element 134 relative to the end caps 108, 110. As a further non-limiting example, a plurality of weight plates (not shown) can be releasably disposed around the exterior portion 118 of the end caps 108, 110 and adjacent the integral hub 114. Accordingly, the retaining element 134 can be positioned to secure the weight plates against the integral hub 114. It is understood when the outer hub 120 is disposed adjacent the integral hub 114, the weight plates are disposed adjacent the outer hub 120 and secured against the outer hub 120.

At least one displaceable component 136 such as a flowable component (e.g. at least one fluid or granular material), a slidable component (e.g. at least one linear slide), a rolling component (e.g. at least one generally spherical body), or any combination thereof, for example, is disposed within the chamber 106. One of more displaceable components 136 fill at least a portion of the chamber 106, wherein the displaceable components 136 can move therein. It is also contemplated that at least a portion of the main body 102 and/or the end caps 108, 110 may include at least one dampening member (not shown) disposed thereon or formed therein such as a rubber mount, for example, to attenuate a noise and vibration produced when the displaceable components 136 contact the main body 102 and/or the end caps 108, 110 during operation.

In use, the interior portions 116 of each of the end caps 108, 110 are inserted into the opposing ends 102, 104 of the main body 101. In the embodiment shown, the first end cap 108 is solid and effectively seals the first end 102 of the main body 101, while the second end cap 110 includes the channel 128 to allow the displaceable component 136 to be exchanged within the chamber 106. When the end caps 108, 110 are in position, the integral hubs 114 abut the main body 101. The outer hubs 120 are disposed adjacent the integral hubs 114 and secured in position by the retaining elements 134. It is understood that a desired number of weight plates can be positioned between the retaining elements 134 and the outer hubs 120. It is further understood that gaskets or O-rings can be positioned between the retaining elements 134 and the outer hubs 120 to provide a friction therebetween to militate against an undesired relative rotation. Prior to, during, or after assembly, the chamber 106 of the exercise device 100 can be filled with the displaceable component 136. It should be understood that a selected number or amount of the displaceable component 136 can be disposed within the chamber 106 to provide a selected total weight to the exercise device 100. One or more baffles (not shown) can be disposed within the chamber 106 to restrict the movement of the displaceable component 136 therein.

Figure 6:
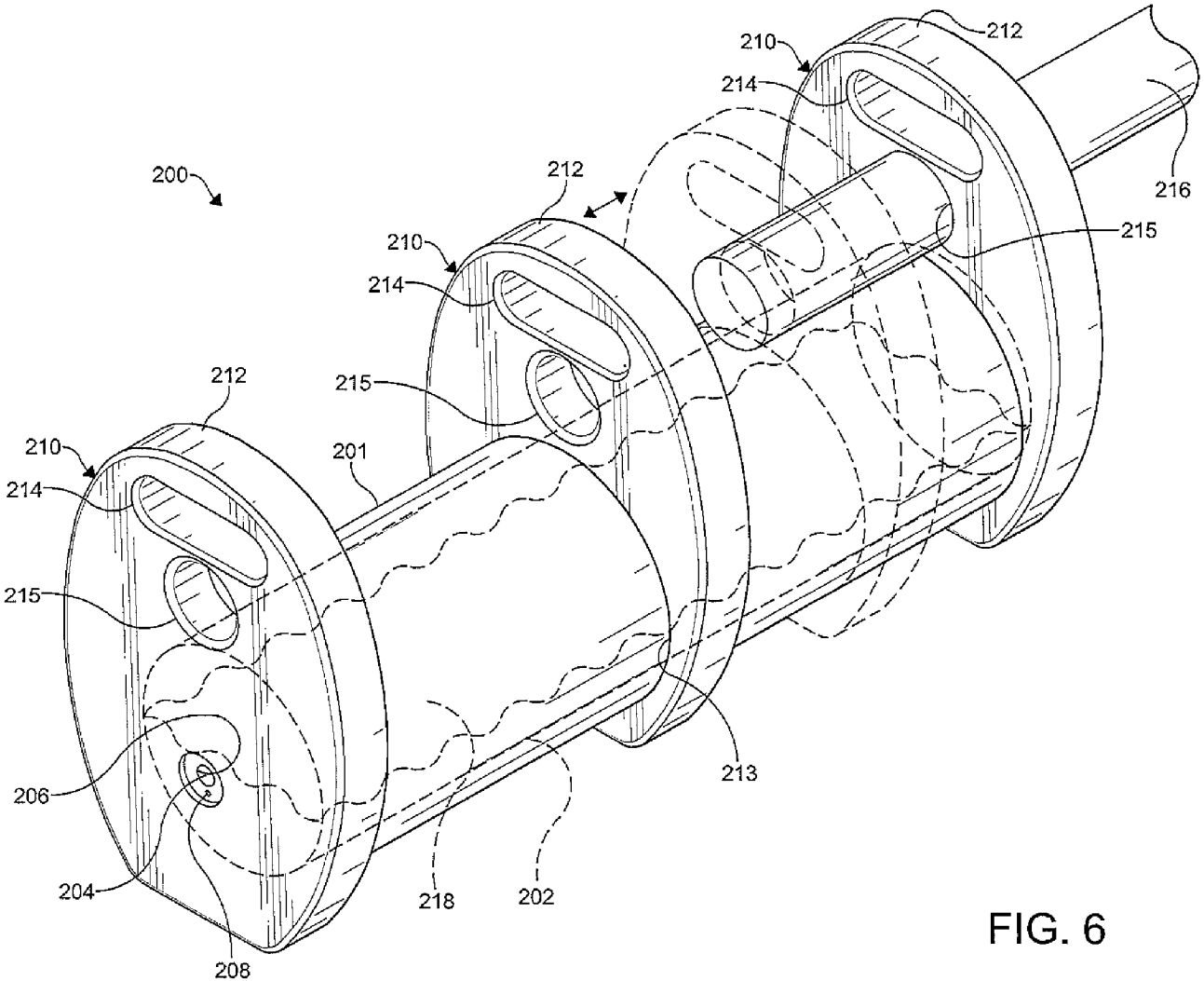
FIG. 6 is a perspective view of an exercise device according to another embodiment of the invention.

In FIG. 6, an exercise device 200 is illustrated showing another embodiment of the invention. The exercise device 200 includes a main body 201 having a substantially media tight chamber 202 formed therein. As a non-limiting example, the chamber 202 is substantially centrally formed along a longitudinal axis of the main body 201. In the illustrated embodiment, the main body 201 has a generally cylindrical shape and the chamber 202 is substantially linear. It should be understood that the main body 201 can include bends and curved portions, for example. As a non-limiting example, a plug 204 is removeably received in an opening 206 formed in the main body 201 to selectively allow a fluid to pass into/out of the chamber 202. As a further non-limiting example, a port 208 or purge hole is in fluid communication with the chamber 202 to allow air from the chamber 202 to pass therethrough during a filling operation, as understood in the art.

In the embodiment shown, a plurality of interface elements 210 is coupled to the main body 201 to allow a user to directly and/or indirectly engage the exercise device 200 to execute a lifting and/or a lateral motion. As a non-limiting example, each of the interface elements 210 includes a main body 212 receiving at least a portion of the main body 201 therethrough to facilitate coupling the main body 201 to the interface elements 210. In certain embodiments, at least one of the interface elements 210 includes an aperture 213 formed therethrough to receive the main body 201 to slidably couple the main body 201 to the at least one of the interface elements 210. It is understood that the slidable engagement between the at least one of the interface elements 210 and the main body 201 allows adjustment of a spacing between the at least one of the interface elements 210 and the other of the interface elements 210. In the embodiment shown, a pair of the interface elements 210 is fixedly disposed adjacent opposing ends of the main body 201 and another of the interface elements 210 is slidably coupled to the main body 201 intermediate the pair of the interface elements 210.

As a non-limiting example, each of the interface elements 210 includes a handle portion 214 and a through-hole 215. As shown, the handle portions 214 provide a means for a user to grasp the interface elements 210 to lift or move the exercise device 200. It is understood that the size, shape, and position of the handle portions 214 can be varied. The through-holes

215 are shown interposed between the handle portions 214 of the respective interface element 210 and the main body 201. As a non-limiting example, the through-holes 215 are sized to receive at least a portion of a conventional barbell 216 therethrough to couple the exercise device 200 to the barbell 216 in a manner consistent with a conventional weight plate. For this purpose, the at least one of the interface elements 210 that is slidably coupled to the main body 201 can be positioned to facilitate a secure coupling of the exercise device 200 and the barbell 216.

At least one displaceable component 218 such as a flowable component (e.g. at least one fluid or granular material), a slidable component (e.g. at least one linear slide), a rolling component (e.g. at least one generally spherical body), or any combination thereof, for example, is disposed within the chamber 202. One or more displaceable components 218 fill at least a portion of the chamber 202, wherein the displaceable components 218 can move therein. It should be understood that a selected number and amount of the displaceable component 218 can be disposed within the chamber 202 to provide a selected total weight to the exercise device 200. One or more baffles (not shown) can be disposed within the chamber 202 to restrict the movement of the displaceable component 218 therein. It is also contemplated that at least a portion of the main body 201 may include at least one dampening member (not shown) disposed thereon or formed therein such as a rubber mount, for example, to attenuate a noise and vibration produced when the displaceable component 218 contacts portions of the main body 201 during operation.

In use, the exercise device 200 can be directly (e.g. via the handle portions 214) and/or indirectly (e.g. via the barbell 216 coupled to the exercise device 200) engaged by a user. Accordingly, the displaceable component 218 provides sensory feedback to the user in respect of maintaining the exercise device 200 in a substantially level position while in use.

Figure 7:
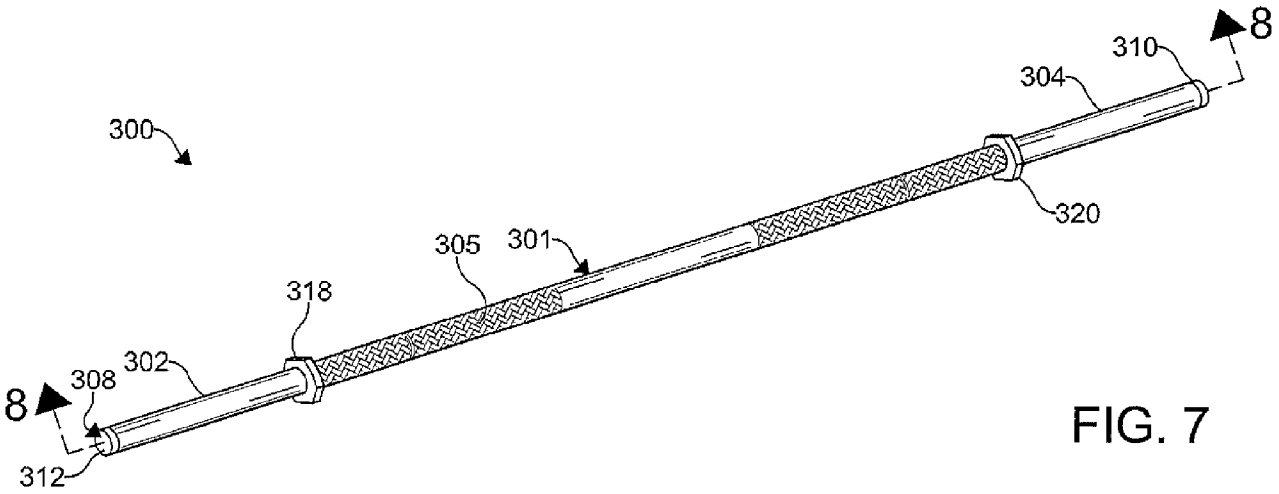
FIG. 7 is a perspective view of an exercise device according to another embodiment of the invention.
Figure 8:
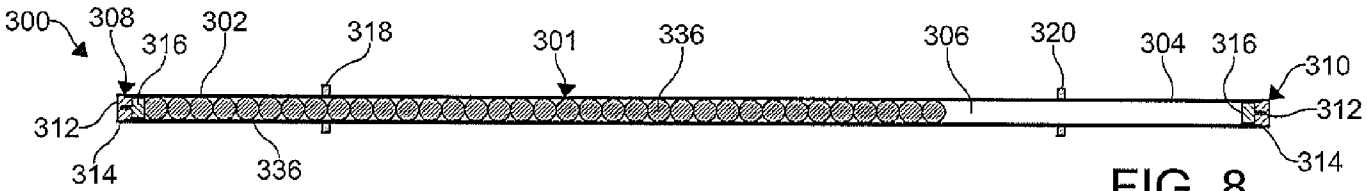
FIG. 8 is a cross-sectional elevational view of the exercise device illustrated in FIG. 7 taken along section line 8-8.
Figure 9:
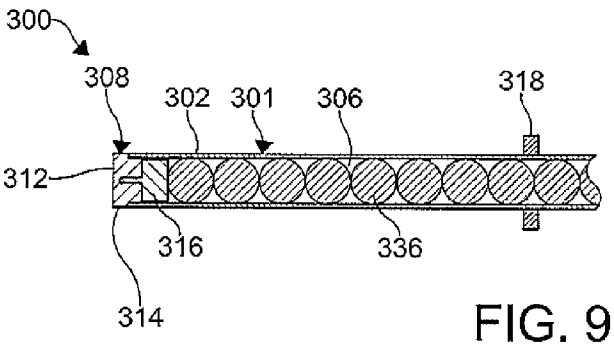
FIG. 9 is an enlarged fragmentary cross-sectional view of a portion of the exercise device illustrated in FIGS. 7-8.

In FIGS. 7-9, an exercise device 300 is illustrated showing another embodiment of the invention. The exercise device 300 includes a main body 301 having opposing ends 302, 304. As a non-limiting example, the main body 301 is a substantially cylindrical hollow tube having a length of about forty-eight (48) inches. As another non-limiting example, the main body 301 is a substantially cylindrical hollow tube having a length of about eighty-four (84) inches. As yet another non-limiting example, the main body 301 is similar in size and shape to a conventional Olympic barbell. However, it is understood that the main body 301 can have any shape and size as desired. It is further understood that the main body 301 can include additional features to enhance a grip of the user onto the exercise device 300 such as knurls 305 (shown in FIG. 7) formed therein, for example. Further, the main body 301 can be configured to receive a plurality of weight plates (not shown) as appreciated by one skilled in the art.

A chamber 306 (shown in FIGS. 8-9) is substantially centrally formed within the main body 301 along a longitudinal axis thereof. In the illustrated embodiment, the main body 301 and the chamber 306 are substantially linear. It should be understood that the main body 301 can include bends and curved portions, for example. The main body 301 typically includes end caps 308, 310 or inserts disposed in/on the opposing ends 302, 304 thereof. The end caps 308, 310 can be formed from any suitable material (e.g. a metal material or a non-metal material) and by any suitable process as desired. In certain embodiments, the end caps 308, 310 are threadably engaged with the respective ends 302, 304. In other certain embodiments, at least one of the end caps 308, 310 is removably disposed in the main body 301 to facilitate forming a substantially media tight seal between the main body 301 and the at least one of the end caps 308, 310. It should be understood that the end caps 308, 310 can include a sealing member such as an O-ring, a flat gasket, and the like, for example.

As shown in FIGS. 8-9, each of the end caps 308, 310 includes a main body 312 having a shoulder 314 circumferentially disposed around the main body 312 and extending radially outwardly therefrom.

In the embodiment shown, a pair of spaced apart hubs 318, 320 is circumferentially disposed around the main body 301 extending radially outwardly therefrom. As a non-limiting example, each of the hubs 318, 320 is disposed adjacent one of the respective ends 302, 304 of the main body 301. Each of the hubs 318, 320 can be integrally formed with the main body 301 or separately formed as distinct components if desired. As shown in FIGS. 8-9, the hubs 318, 320 are separate components that are coupled to the main body 301 by a weld. It is understood, however, that the hubs 318, 320 can be coupled to the main body 301 by any means (e.g. a fastener, an adhesive, etc.) as desired. In certain embodiments, the hubs 318, 320 each have a generally hexagonal shape. However, the hubs 318, 320 can have any size and shape, as desired.

Each of the ends 302, 304 of the main body 301 may be configured to receive a retaining element or collar (not shown). In certain embodiments, at least a portion of each of the ends 302, 304 is configured to threadably engage the retaining element and militate against undesired movement of the retaining element relative to the ends 302, 304. As a non-limiting example, a plurality of weight plates not shown) can be releasably disposed on the main body 301 between the ends 302, 304 and the respective hubs 318, 320. Accordingly, the retaining elements can be positioned to secure the weight plates against the hubs 318, 320. It is understood that the hubs 318, 320 may be coupled to the main body 301 so that the weight plates can be positioned substantially flush against the hubs 318, 320 when the weight plates are disposed on the main body 301.

At least one displaceable component 336 such as a flowable component (e.g. at least one fluid or granular material), a slidable component (e.g. at least one linear slide), a rolling component (e.g. at least one generally spherical body shown in FIGS. 8-9), or any combination thereof, for example, is disposed within the chamber 306. In certain embodiments, the displaceable component 336 is a plurality of generally spherical bodies each having a weight of about 0.5 pounds and a diameter of about forty-four (44) millimeters or one and three-fourths (1.75) inches. It is understood that the generally spherical bodies can have any shape and size as desired. It is further understood that the generally spherical bodies can be formed from any suitable material as desired such as a metal material (e.g. a steel material), a non-metal material (e.g. a silicon material), a ceramic material, a polymeric material, or any combination thereof, for example. As a non-limiting example, the forty-eight (48) inch main body 301 includes about ten (10) pounds (i.e. twenty (20) generally spherical bodies). As another non-limiting example, the eighty-four (84) inch main body 301 includes about twenty (20) pounds, and more specifically seventeen and one-half (17.5) pounds (i.e. thirty-five (35) generally spherical bodies). In other certain embodiments, the displaceable component 336 is a solid cylindrical linear slide having a weight of about 28.0 pounds and a length of about three-fourths the length of the main body 301. It is understood, however, that the linear slide can have any shape, size, and contour as desired and can be formed from any suitable material as desired such as a metal material (e.g. a steel material), a non-metal material (e.g. a silicon material), a ceramic material, a polymeric material, or any combination thereof, for example. One or more displaceable components 336 fill at least a portion of the chamber 306, wherein the displaceable components 336 can move therein.

In certain embodiments, the main body 312 of each of the end caps 308, 310 may include at least one dampening member 316 extending axially outwardly from the main body 312. The dampening member 316 can be integrally formed with the main body 312 or separately formed as a distinct component if desired. As shown in FIGS. 8-9, the dampening member 316 is a separate component that is coupled to the main body 312 by a fastener (not shown). It is understood, however, that the dampening member 316 can be coupled to the main body 312 by any means (e.g. a weld, an adhesive, press fitting, etc.) as desired. In certain embodiments, each of the dampening members 316 has a substantially cylindrical shape and a diameter that is smaller than an internal diameter of the main body 301 of the exercise device 300. However, the dampening member 316 can have any size and shape as desired. It is also understood that the dampening member 316 can be any dampening member as desired such as a rubber mount, for example, to attenuate a noise and vibration produced when the displaceable component 336 contacts portions of the main body 301 and/or the end caps 308, 310 during operation.

In certain embodiments, at least one of the main body 301 and the displaceable component 336 is configured to provide visual feedback to the user of the exercise device 300. For example, the main body 301 can be formed from a substantially transparent or translucent material or include an aperture formed therein to permit the user to view the displaceable component 336 and a movement thereof within the main body 301. As another non-limiting example, each of the displaceable components 336 can be a different color or include coded indicia to provide the visual feedback to the user. The displaceable component 336 also provides sensory feedback to the user in respect of maintaining the exercise device 300 in a substantially level position while in use.

In use, one of the end caps 308, 310 is inserted into one of the ends 302, 304 of the main body 301 to provide a closure thereto. Once one of the end caps 308, 310 is assembled with the main body 301, the chamber 306 of the exercise device 300 may be filled with the displaceable component 336 if desired. It is understood that a selected number and amount of the displaceable component 336 can be disposed within the chamber 306 to provide a selected total weight to the exercise device 300. One or more baffles (not shown) can be disposed within the chamber 306 to restrict the movement of the displaceable component 336 therein. Alternatively, the chamber 306 of the exercise device 300 may remain empty. Thereafter, another one of the end caps 308, 310 is inserted into another one of the ends 302, 304 of the main body 301 to provide a closure thereto. When the end caps 308, 310 are in position, a desired number of weight plates can be positioned between the ends 302, 304 and the respective hubs 318, 320.

Figure 10:
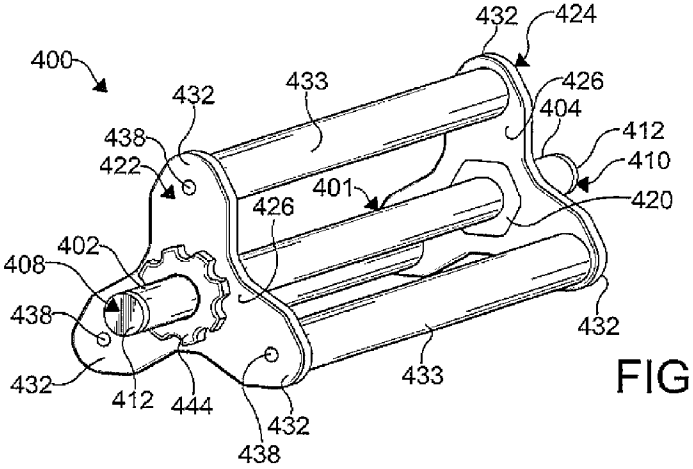
FIG. 10 is a perspective view of an exercise device according to yet another embodiment of the invention.
Figure 11:
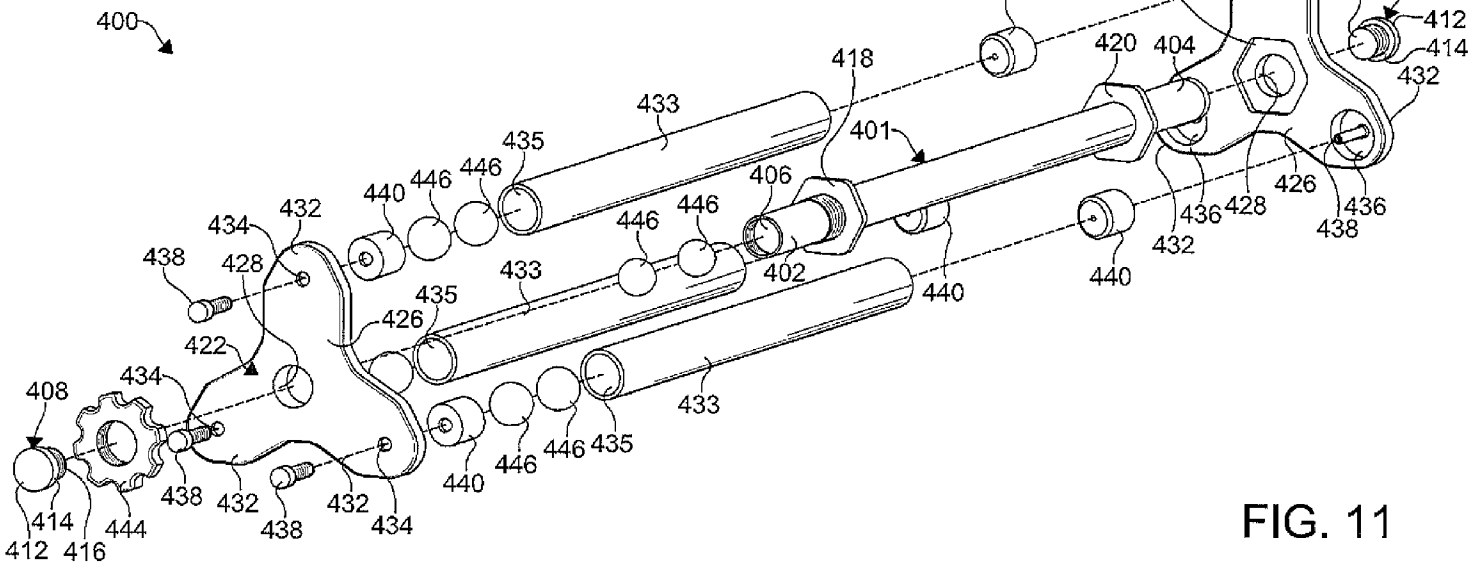
FIG. 11 is a partially exploded view of the exercise device illustrated in FIG. 10.

In FIGS. 10-11, an exercise device 400 is illustrated showing another embodiment of the invention. The exercise device 400 includes a main body 401 having opposing ends 402, 404. As a non-limiting example, the main body 401 is a substantially cylindrical hollow tube having a length of about forty-eight (48) inches. As another non-limiting example, the main body 401 is a substantially cylindrical hollow tube having a length of about eighty-four (84) inches. As yet another non-limiting example, the main body 401 is similar in size and shape to a conventional Olympic barbell. However, it is understood that the main body 401 can have any shape and size as desired. It is further understood that the main body 401 can include additional features to enhance a grip of the user onto the exercise device 400 such as knurls (not shown) formed therein, for example. Further, the main body 401 can be configured to receive a plurality of weight plates (not shown) as appreciated by one skilled in the art.

A chamber 406 (shown in FIG. 11) is substantially centrally formed within the main body 401 along a longitudinal axis thereof. In the illustrated embodiment, the main body 401 and the chamber 406 are substantially linear. It should be understood that the main body 401 can include bends and curved portions, for example. The main body 401 typically includes end caps 408, 410 or inserts disposed in/on the opposing ends 402, 404 thereof. In certain embodiments, the end caps 408, 410 are threadably engaged with the respective ends 402, 404. In other certain embodiments, at least one of the end caps 408, 410 is removably disposed in the main body 401 to facilitate forming a substantially media tight seal between the main body 401 and the at least one of the end caps 408, 410. It should be understood that the end caps 408, 410 can include a sealing member such as an O-ring, a flat gasket, and the like, for example. The end caps 408, 410 can be formed from any suitable material (e.g. a metal material or a non-metal material) and by any suitable process as desired.

As shown in FIG. 11, each of the end caps 408, 410 includes a main body 412 having a shoulder 414 circumferentially disposed around the main body 412 and extending radially outwardly therefrom. In certain embodiments, the main body 412 of each of the end caps 408, 410 includes an interior portion 416 extending axially outwardly from the shoulder 414. The interior portion 416 can be integrally formed with the main body 412 or separately formed as a distinct component if desired. It is understood that the interior portion 416 can be coupled to the main body 412 by any means (e.g. a weld, a fastener, an adhesive, etc.) as desired. In certain embodiments, each of the interior portions 416 has a substantially cylindrical shape and a diameter that is smaller than an internal diameter of the main body 401 of the exercise device 400. However, the interior portion 416 can have any size and shape as desired.

In the embodiment shown, a pair of spaced apart inner hubs 418, 420 is circumferentially disposed around the main body 401 extending radially outwardly therefrom. As a non-limiting example, each of the inner hubs 418, 420 is disposed adjacent one of the respective ends 402, 404 of the main body 401. Each of the inner hubs 418, 420 can be integrally formed with the main body 401 or separately formed as distinct components if desired. It is understood that the inner hubs 418, 420 can be coupled to the main body 401 by any means (e.g. a fastener, a weld, an adhesive, etc.) as desired. In certain embodiments, the inner hubs 418, 420 each have a generally hexagonal shape. However, the inner hubs 418, 420 can have any size and shape, as desired.

In certain embodiments, an outer hub 422 is disposed adjacent the inner hub 418 and an outer hub 424 is disposed adjacent the inner hub 420. It is understood that the outer hubs 422, 424 can be formed from any suitable material as desired. Each of the outer hubs 422, 424 includes a main body 426. As shown in FIG. 11, the main body 426 has a central aperture 428 formed therein and a recessed portion 430 circumferentially formed adjacent the central aperture 428. As a non-limiting example, the central aperture 428 is generally circular to receive an associated one of the ends 402, 404 therethrough. As a further non-limiting example, the recessed portion 430 has a shape (e.g. generally hexagonal) to receive at least a portion of an associated one of the inner hubs 418, 420 and thereby secure the outer hubs 422, 424 to the respective inner hubs 418, 420. It is understood that the outer hubs 422, 424 can be bonded to the inner hubs 418, 420 if desired.

The main body 426 of each of the outer hubs 422, 424 may also include one or more lobe portions 432 extending radially outwardly from the central aperture 428 of the main body 426. A supplemental containment article 433 extends between each associated pair of the lobe portions 432 of opposing outer hubs 422, 424. In certain embodiments, the supplemental containment article 433 is a substantially cylindrical hollow tube. A chamber 435 (shown in FIG. 11) is substantially centrally formed within the supplemental containment article 433 along a longitudinal axis thereof. In the illustrated embodiment, the supplemental containment article 433 and the chamber 435 are substantially linear. It is understood that the supplemental containment article 433 and the chamber 435 can include bends and curved portions if desired. As a non-limiting example, the outer hubs 422, 424 include three lobe portions 432 each having one of the supplemental containment articles 433 extending therebetween. It is understood that the outer hubs 422, 424 can have any shape and size as desired and include fewer or additional lobe portions 432 than shown.

As shown in FIG. 11, each of the lobe portions 432 includes an aperture 434 formed therein and a recessed portion 436 circumferentially formed adjacent the aperture 434. As a non-limiting example, the aperture 434 is generally circular and configured to receive a fastener 438 therethrough. As a further non-limiting example, the recessed portion 436 has a shape (e.g. generally circular) to receive at least a portion of an interior portion 440 therein.

The interior portions 440 extend axially outwardly from the lobe portions 432. The interior portions 440 can be integrally formed with the main body 426 of the outer hubs 422, 424 or separately formed as distinct components if desired. As shown in FIG. 11, the interior portions 440 are separate components that are coupled to the main body 426 of the outer hubs 422, 424 by the fasteners 438. It is understood, however, that the interior portions 440 can be coupled to the main body 426 by any means (e.g. a weld, an adhesive, etc.) as desired. In certain embodiments, each of the interior portions 440 has a substantially cylindrical shape. As a non-limiting example, each of the interior portions 440 has a diameter that is smaller than an internal diameter of the chamber 435 of the associated supplemental containment article 433. However, the interior portions 440 can have any size and shape as desired. Each of the interior portions 440 is configured to be removably disposed in the supplemental containment article 433 to facilitate forming a substantially media tight seal between the supplemental containment article 433 and the outer hubs 422, 424. It should be understood that the interior portions 440 or the outer hubs 422, 424 can include a sealing member such as an O-ring, a flat gasket, and the like, for example, to further facilitate forming the substantially media tight seal. It is also understood that at least one of the interior portions 440 can be formed integrally with the supplemental containment article 433 if desired.

In certain embodiments, each of the ends 402, 404 of the main body 401 may be configured to receive a retaining element or collar 444 thereon. As shown in FIG. 11, at least a portion of each of the ends 402, 404 is configured to threadably engage the retaining element 444 and militate against undesired movement of the outer hubs 422, 424 and the retaining elements 444 relative to the ends 402, 404.

As a non-limiting example, a plurality of weight plates (not shown) can be releasably disposed on the main body 401 between the ends 402, 404 and the outer hubs 422, 424. Accordingly, the retaining elements 444 can be positioned to secure the weight plates against the outer hubs 422, 424. It is understood that the outer hubs 422, 424 may be received on the main body 401 so that the weight plates can be positioned substantially flush against the outer hubs 422, 424 when the weight plates are disposed on the main body 401.

At least one displaceable component 446 such as a flowable component (e.g. at least one fluid or granular material), a slidable component (e.g. at least one linear slide), a rolling component (e.g. at least one generally spherical body shown in FIG. 11), or a combination thereof, for example, is disposed within the chambers 406, 435. In certain embodiments, the displaceable component 446 is a plurality of generally spherical bodies each having a weight of about 0.5 pounds and a diameter of about forty-four (44) millimeters or one and three-fourths (1.75) inches. It is understood that the generally spherical bodies can have any shape and size as desired. It is further understood that the generally spherical bodies can be formed from any suitable material as desired such as a metal material (e.g. a steel material), a non-metal material (e.g. a silicon material), a ceramic material, a polymeric material, or any combination thereof, for example. As a non-limiting example, the forty-eight (48) inch main body 401 includes about ten (10) pounds (i.e. twenty (20) generally spherical bodies). As another non-limiting example, the eighty-four (84) inch main body 401 includes about twenty (20) pounds, and more specifically seventeen and one-half (17.5) pounds (i.e. thirty-five (35) generally spherical bodies). As yet another non-limiting example, each of the supplemental containment articles 433 includes about ten (10) pounds (i.e. twenty (20) generally spherical bodies). In other certain embodiments, the displaceable component 446 is a solid cylindrical linear slide having a weight of about 28.0 pounds and a length of about three-fourths the length of the respective main body 401 or supplemental containment article 433. It is understood, however, that the linear slide can have any shape, size, and contour as desired and can be formed from any suitable material as desired such as a metal material (e.g. a steel material), a non-metal material (e.g. a silicon material), a ceramic material, a polymeric material, or any combination thereof, for example. One or more displaceable components 446 fill at least a portion of at least one of the chambers 406, 435, wherein the displaceable components 446 can move therein. It is also contemplated that at least a portion of the main body 401, the supplemental containment articles 433, the end caps 408, 401, and/or the interior portions 440 may include at least one dampening member (not shown) disposed thereon or formed therein such as a rubber mount, for example, to attenuate a noise and vibration produced when the displaceable components 446 contact portions thereof during operation.

In certain embodiments, at least one of the main body 401, the supplemental containment articles 433, and the displaceable component 446 is configured to provide visual feedback to the user of the exercise device 400. For example, the main body 401 and/or at least one of the supplemental containment articles 433 can be formed from a substantially transparent or translucent material or include an aperture formed therein to permit the user to view the displaceable component 446 and a movement thereof within the main body 401. As another non-limiting example, each of the displaceable components 446 can be a different color or include coded indicia to provide the visual feedback to the user. The displaceable component 446 also provides sensory feedback to the user in respect of maintaining the exercise device 400 in a substantially level position while in use.

In use, the interior portion 416 of one of the end caps 408, 410 is inserted into one of the ends 402, 404 of the main body 401 to provide a closure thereto. Once one of the end caps 408, 410 is assembled with the main body 401, the chamber 406 of the exercise device 400 may be filled with the displaceable component 446 if desired. Alternatively, the chamber 406 of the exercise device 400 may remain empty. Thereafter, the interior portion 416 of another one of the end caps 408, 410 is inserted into another one of the ends 402, 404 of the main body 401 to provide a closure thereto.

Optionally, the outer hubs 422, 424 are disposed adjacent the inner hubs 418, 420 having one or more of the supplemental containment articles 433 extending therebetween. More particularly, the interior portions 440 of the outer hubs 422, 424 are inserted into the chamber 435 of the supplemental containment articles 433 to support and maintain a position thereof. The chamber 435 of each of the supplemental containment articles 433 can be filled with the displaceable component 446 if desired. Alternatively, the chamber 435 may remain empty. The outer hubs 422, 424 are secured in position by the retaining elements 444. It is understood that a selected amount of the displaceable component 446 can be disposed within the chambers 406, 435 to provide a selected total weight to the exercise device 400. One or more baffles (not shown) can be disposed within the chambers 406, 435 to restrict the movement of the displaceable component 446 therein if desired. When the outer hubs 422, 424 are in position, a desired number of weight plates can be positioned between the retaining elements 444 and the respective outer hubs 422, 424.

Figure 12:
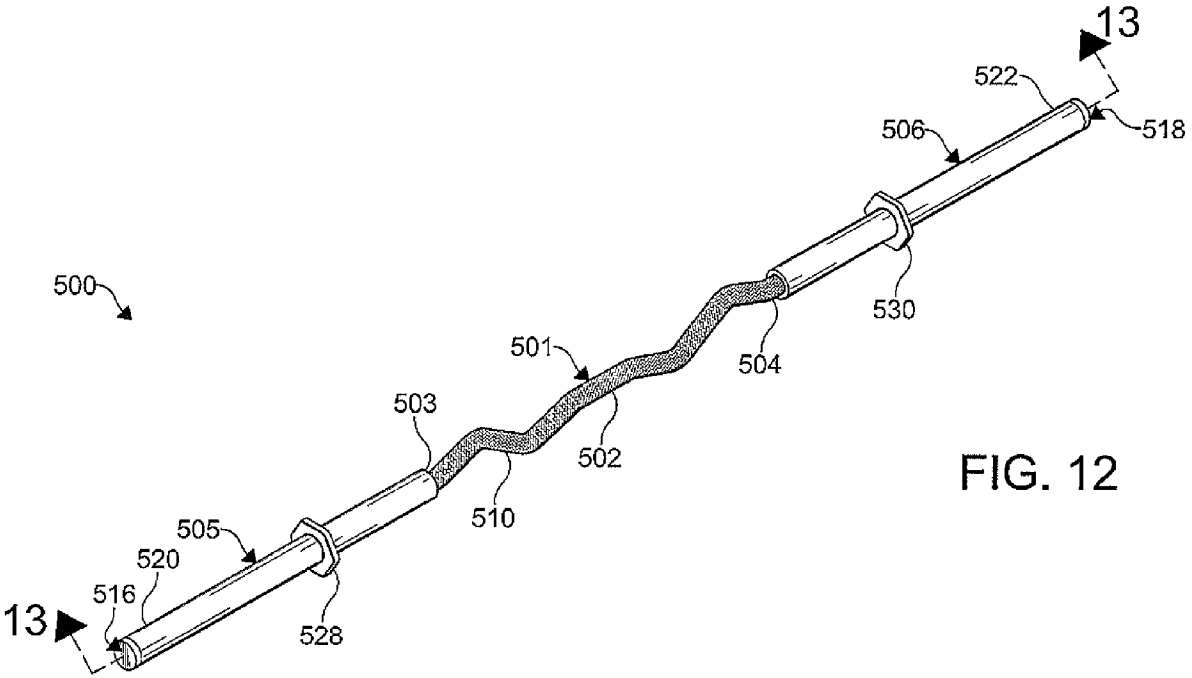
FIG. 12 is a perspective view of an exercise device according to yet another embodiment of the invention.
Figure 13:
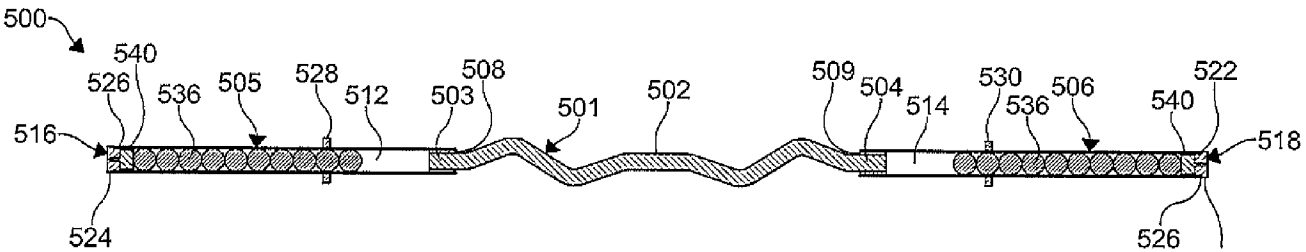
FIG. 13 is a cross-sectional elevational view of the exercise device illustrated in FIG. 12 taken along section line 12-12.

In FIGS. 12-13, an exercise device 500 is illustrated showing another embodiment of the invention. The exercise device 500 includes a main body 501. As a non-limiting example, the main body 501 has a generally cylindrical shape and a length of about forty-eight (48) inches. As another non-limiting example, the main body 501 has a generally cylindrical shape and a length of about eighty-four (84) inches. As yet another non-limiting example, the main body 501 is similar in size and shape to a conventional Olympic barbell. However, it is understood that the main body 501 can have any shape and size as desired.

The main body 501 includes a bar 502 having opposing ends 503, 504 and a pair of opposing end extensions 505, 506 coupled to the respective ends 503, 504 of the bar 502. The end extensions 505, 506 can be coupled to the bar 502 by any means as desired such as welding, brazing, soldering, adhesive, fasteners, and the like, for example. As illustrated, the end extensions 505, 506 are joined to the bar 502 using a pair of couplers 508, 509. Each of the couplers 508, 509 is interposed between one of the end extensions 505, 506 and the respective one of the ends 503, 504 of the bar 502. The couplers 508, 509 can be any size and shape as desired to militate against an undesired decoupling of the end extensions 505, 506 from the bar 502. As a non-limiting example, each of the couplers 508, 509 is welded to a corresponding one of the ends 503, 504 of the bar 502 and a corresponding one of the end extensions 505, 506. Further, the end extensions 505, 506 can be configured to receive a plurality of weight plates (not shown) as appreciated by one skilled in the art. The bar 502 can include additional features to enhance a grip of the user onto the exercise device 500 such as knurls 510 (shown in FIG. 12) formed therein, for example. In the illustrated embodiment, the bar 502 includes bends and curved portions such as an E-Z curl bar, for example. It is understood, however, that the bar 502 can be substantially linear if desired.

The main body 501 further includes a pair of hollow substantially media tight chambers 512, 514 formed therein. In certain embodiments, the chamber 512 is formed in the end extension 505 and the chamber 514 is formed in the end extension 506. It is understood that fewer or additional chambers than shown can be formed in the main body 501 such as at least one chamber formed in the bar 502. The chambers 512, 514 shown are substantially linear. However, it is also contemplated that the chambers 512, 514 can include bends and curved portions if desired.

Each of the chambers 512, 514 typically includes end caps 516, 518 or inserts disposed in/on respective ends 520, 522 of the end extensions 505, 506. The end caps 516, 518 can be formed from any suitable material (e.g. a metal material or a non-metal material) and by any suitable process as desired. In certain embodiments, the end caps 516, 518 are threadably engaged with the respective ends 520, 522. In other certain embodiments, the end caps 516, 518 include a sealing member such as an O-ring, a flat gasket, and the like, for example. As shown in FIG. 13, each of the end caps 516, 518 includes a main body 524 having a shoulder 526 circumferentially disposed around the main body 524 and extending radially outwardly therefrom.

In the embodiment shown, a pair of spaced apart hubs 528, 530 is circumferentially disposed around the main body 501 extending radially outwardly therefrom. As a non-limiting example, each of the hubs 528, 530 is interposed between the ends 503, 504 of the bar 502 and the ends 520, 522 of the end extensions 505, 506. Each of the hubs 528, 530 can be integrally formed with the main body 501 or separately formed as distinct components if desired. As shown in FIG. 13, the hubs 528, 530 are separate components that are coupled to the end extensions 505, 506 by a weld. It is understood, however, that the hubs 528, 530 can be coupled to the end extensions 506, 507 by any means (e.g. a fastener, an adhesive, etc.) as desired. In certain embodiments, the hubs 528, 530 each have a generally hexagonal shape. However, the hubs 528, 530 can have any size and shape, as desired.

Each of the ends 520, 522 of the end extensions 505, 506 may be configured to receive a retaining element or collar (not shown). In certain embodiments, at least a portion of each of the ends 520, 522 is configured to threadably engage the retaining element and militate against undesired movement of the retaining element relative to the ends 520, 522. As a non-limiting example, a plurality of weight plates not shown) can be releasably disposed on the end extensions 505, 506 between the ends 520, 522 and the respective hubs 528, 530. Accordingly, the retaining elements can be positioned to secure the weight plates against the hubs 528, 530. It is understood that the hubs 528, 530 may be coupled to the end extensions 505, 506 so that the weight plates can be positioned substantially flush against the hubs 528, 530 when the weight plates are disposed on the main body 501.

At least one displaceable component 536 such as a flowable component (e.g. at least one fluid or granular material), a slidable component (e.g. at least one linear slide), a rolling component (e.g. at least one generally spherical body shown in FIG. 13), or any combination thereof, for example, is disposed within one or more of the chambers 512, 514. In certain embodiments, the displaceable component 536 is a plurality of generally spherical bodies each having a weight of about 0.5 pounds and a diameter of about forty-four (44) millimeters or one and three-fourths (1.75) inches. It is understood that the generally spherical bodies can have any shape and size as desired. It is further understood that the generally spherical bodies can be formed from any suitable material as desired such as a metal material (e.g. a steel material), a non-metal material (e.g. a silicon material), a ceramic material, a polymeric material, or any combination thereof, for example. As a non-limiting example, each of the chambers 512, 514 includes about five (5) pounds (i.e. twenty (10) generally spherical bodies). In other certain embodiments, the displaceable component 536 is a solid cylindrical linear slide having a weight of about five (5) pounds and a length of about three-fourths the length of the associated one of the chambers 512, 514. It is understood, however, that the linear slide can have any shape, size, and contour as desired and can be formed from any suitable material as desired such as a metal material (e.g. a steel material), a non-metal material (e.g. a silicon material), a ceramic material, a polymeric material, or any combination thereof, for example. One or more displaceable components 536 fill at least a portion of the chambers 512, 514, wherein the displaceable components 536 can move therein.

In certain embodiments, the main body 501 of each of the end caps 516, 518 may include at least one dampening member 540 extending axially outwardly from the main body 524 of the end caps 516, 518. The dampening member 540 can be integrally formed with the main body 524 or separately formed as a distinct component if desired. As shown, the dampening member 540 is a separate component that is coupled to the main body 524 by a fastener (not shown). It is understood, however, that the dampening member 540 can be coupled to the main body 524 by any means (e.g. a weld, an adhesive, press fitting, etc.) as desired. In certain embodiments, each of the dampening members 540 has a substantially cylindrical shape and a diameter that is smaller than an internal diameter of the main body 501 of the exercise device 500. However, the dampening member 540 can have any size and shape as desired. It is also understood that the dampening member 540 can be any dampening member as desired such as a rubber mount, for example, to attenuate a noise and vibration produced when the displaceable component 536 contacts portions of the main body 501 and/or the end caps 516, 518 during operation.

In certain embodiments, at least one of the main body 501 and the displaceable component 536 is configured to provide visual feedback to the user of the exercise device 500. For example, the end extensions 505, 506 of the main body 501 can be formed from a substantially transparent or translucent material or include an aperture formed therein to permit the user to view the displaceable component 536 and a movement thereof within the chambers 512, 514. As another non-limiting example, each of the displaceable components 536 can be a different color or include coded indicia to provide the visual feedback to the user. The displaceable component 536 also provides sensory feedback to the user in respect of maintaining the exercise device 500 in a substantially level position while in use.

In use, the chamber 512 of the exercise device 500 may be filled with the displaceable component 536 if desired. It is understood that a selected number and amount of the displaceable component 536 can be disposed within the chamber 512 to provide a selected total weight to the exercise device 500. One or more baffles (not shown) can be disposed within the chamber 512 to restrict the movement of the displaceable component 536 therein. Alternatively, the chamber 512 of the exercise device 500 may remain empty. Thereafter, the end cap 516 is inserted into the end 520 of the end extension 505 to provide a closure thereto.

Similarly, the chamber 514 of the exercise device 500 may be filled with the displaceable component 536 if desired. It is understood that a selected number and amount of the displaceable component 536 can be disposed within the chamber 514 to provide a selected total weight to the exercise device 500. One or more baffles (not shown) can be disposed within the chamber 514 to restrict the movement of the displaceable component 536 therein. Alternatively, the chamber 514 of the exercise device 500 may remain empty. Thereafter, the end cap 518 is inserted into the end 522 of the end extension 506 to provide a closure thereto. When the end caps 516, 518 are in position, a desired number of weight plates can be positioned between the ends 520, 522 and the respective hubs 528, 530.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An exercise device comprising:

a main body including at least one chamber formed therein, at least a portion of the main body configured to be grasped by a user, wherein the main body has a length greater than thirty-two inches;

an end cap having an interior portion disposed within the main body and an exterior portion extending axially outwardly from the main body;

a first displaceable component disposed within the at least one chamber, wherein the first displaceable component is at least one rolling component; and a baffle disposed within the at least one chamber of the main body to restrict a movement of the first displaceable component within the at least one chamber of the main body.

2. The exercise device according to claim 1, wherein the at least one chamber of the main body is formed in at least one end extension thereof.

3. The exercise device according to claim 1, further comprising at least one inner hub and at least one outer hub disposed on the main body.

4. The exercise device according to claim 3, wherein the at least one outer hub includes at least one lobe portion.

5. The exercise device according to claim 4, further comprising at least one containment article extending between a plurality of the outer hubs.

6. The exercise device according to claim 5, wherein the at least one containment article includes at least one chamber formed therein.

7. The exercise device according to claim 6, wherein the at least one chamber of the at least one containment article extends along substantially an entire length thereof.

8. The exercise device according to claim 6, further comprising a second displaceable component disposed in the at least one chamber of the containment article.

9. The exercise device according to claim 8, wherein the second displaceable component is at least one of a flowable component, a slidable component, and a rolling component.

10. The exercise device according to claim 8, wherein each of the containment articles includes about 0.0 pounds to about 10 pounds of the second displaceable component.

11. The exercise device according to claim 8, further comprising a baffle disposed within the at least one chamber of the at least one containment article to restrict a movement of the second displaceable component within the at least one chamber of the at least one containment article.

12. The exercise device according to claim 8, wherein at least one of the main body, the at least one containment article, the first displaceable component, and the second displaceable component is configured to provide visual feedback to the user of the exercise device.

13. An exercise device comprising:

a main body including a plurality of hubs disposed thereon and at least one chamber formed therein, at least a portion of the main body configured to be grasped by a user; and at least one containment article spaced apart from the main body and extending between the hubs of the main body, the at least one containment article including at least one chamber formed therein, wherein at least one displaceable component is disposed within at least one of the at least one chamber of the main body and the at least one chamber of the at least one containment article.

14. The exercise device according to claim 13, wherein at least one of the hubs includes at least one lobe portion.

15. The exercise device according to claim 13, wherein the at least one displaceable component is at least one of a flowable component, a slidable component, and a rolling component.

16. The exercise device according to claim 13, wherein at least one of the main body, the at least one containment article, and the at least one displaceable component is configured to provide visual feedback to the user of the exercise device.

17. An exercise device comprising:

a main body including a first end, a second end, a plurality of outwardly extending hubs disposed on the main body, and at least one chamber formed therein, wherein at least a portion of the main body is configured to be grasped by a user and at least one of the hubs is spaced apart from at least one of the first end and the second end of the main body; and at least one first displaceable component disposed within the at least one chamber of the main body, wherein the at least one first displaceable component is at least one of a flowable component, a slidable component, and a rolling component.

18. The exercise device according to claim 17, further comprising at least one containment article extending between the hubs of the main body, wherein the at least one containment article includes at least one chamber having at least one second displaceable component disposed therein.

19. The exercise device according to claim 1, wherein the at least one chamber of the main body includes only the at least one first displaceable component and air disposed therein.

* * * * *